US006227507B1

(12) United States Patent
Kallio

(10) Patent No.: US 6,227,507 B1
(45) Date of Patent: May 8, 2001

(54) CLOSET SHELVING SYSTEM

(76) Inventor: James H. Kallio, P.O. Box 268, 586 Wheelwright Rd., South Barre, MA (US) 01074

( * ) Notice: Subject to any disclaimer, the term of this patent is extended or adjusted under 35 U.S.C. 154(b) by 0 days.

(21) Appl. No.: 09/265,680

(22) Filed: Mar. 10, 1999

Related U.S. Application Data

(60) Provisional application No. 60/078,499, filed on Mar. 18, 1998.

(51) Int. Cl.[7] ..... A47G 29/02

(52) U.S. Cl. ..... 248/250; 248/235; 248/248; 248/300

(58) Field of Search ..... 248/235, 251, 248/300, 247, 248, 214, 215, 339; 211/90.01, 135; 108/152, 149, 157.13, 180, 108; 312/351

(56) References Cited

U.S. PATENT DOCUMENTS 2,233,725 * 3/1941 Begin ..... 248/300
2,906,487 * 9/1959 Simon ..... 248/248
2,960,761 * 11/1960 Preader ..... 248/248
3,799,416 * 3/1974 Schmaltz ..... 248/339
3,865,336 * 2/1975 Robertson ..... 248/235
4,951,908 * 8/1990 Kallio ..... 248/248
5,775,656 * 7/1998 Roberts et al. ..... 248/250

* cited by examiner

*Primary Examiner*—Leslie A. Braun
*Assistant Examiner*—Gwendolyn Baxter
(74) *Attorney, Agent, or Firm*—Blodgett & Blodgett, P.C.

(57) ABSTRACT

The bracket system of the present invention includes four brackets. The first bracket can be screwed into the side walls of a closet for supporting the ends of a shelf. The second bracket is attachable to the shelf for supporting a cylindrical rod for hanging clothes. The third bracket is adapted to be screwed into the wall of a closet and connected to a first bracket for supporting the end of a shelf at any point along the length of the wall. The fourth bracket is adapted to be attached to the end of a shelf for supporting the end of a second shelf which forms a continuous shelving with the first shelf.

16 Claims, 14 Drawing Sheets

CLOSET SHELVING SYSTEM

CROSS-REFERENCE TO RELATED APPLICATIONS

This application claims the benefit under 35 U.S.C. §119 (e) of prior U.S. Provisional Application No. 60/078,499 filed Mar. 18, 1998; all of which is hereby incorporated by reference.

STATEMENT REGARDING FEDERALLY SPONSORED RESEARCH OR DEVELOPMENT

This invention has been created without the sponsorship or funding of any federally sponsored research or development program.

BACKGROUND OF THE INVENTION

The present invention is directed to a shelving system for closets and to improve shelving brackets for the shelving system. Closets are used for storing a wide range of items, many of which require different means of support. Supporting means for closets include shelves and bars all of which require suitable brackets. Prior art support brackets are generally quite limited for specific supporting functions.

Shelves and bars are typically supported by bracket at the opposite side walls of the closet. This type of support is inadequate for long closets and moderate size closets since the weight of clothes and other items cause the shelves and bars to sag in the middle. This problem is solved by the shelving support assembly shown in my issued U.S. Pat. No. 4,951,908. None of the prior art shelf brackets have means for supporting and/or attaching a cylindrical rod or beam for hanging clothes as is required in a clothes closet. Also, in a walk-in closet where it is desirable to have shelving run continuous along two adjacent walls, there is not, at present, simple means of constructing this effectively. It is desirable with closet organizer type assemblies to have a shelf extend only partially across the rear wall. There is at present no simple means to construct and support shelving that is not the full length of the closet when using just a shelf bracket pair such as that disclosed in my U.S. Pat. No. 4,951,908.

Also, shelf brackets have right and left hand orientations. This requires that both types of brackets be kept in stock. Since the cost of the brackets tends to be greater, it adds a dimension of complexity in manufacturing, handling, and distribution of the product. One such type of shelf bracket combination is shown, for example, in my issued U.S. Pat. No. 4,951,908. These and other difficulties experienced with the prior art shelving support systems for closets have been obviated by the present invention.

It is, therefore, a principal object of the invention to provide a bracket for supporting the ends of a shelf which can be used at either side of the closet.

Another object of the invention is to provide a bracket means in combination with shelving for supporting a cylindrical rod or beam for clothes hanging.

A further object of the invention is to provide bracket combinations for building continuous shelving along adjacent walls, and terminating and supporting a shelf at any point in the horizontal direction, along a wall.

A still further object of the invention is to provide plurality of cooperating bracket components which form a simple and inexpensive solution for constructing all types of residential shelving. This includes the most complex of requirements as in a walk-in closet with continuous shelving along adjacent walls, shelving at various elevated heights, and shelving that terminates at any point on the rear and or side walls.

BRIEF SUMMARY OF THE INVENTION

The bracket system of the present invention includes four brackets. The first bracket can be screwed into the side walls of a closet for supporting the ends of a shelf. The second bracket is attachable to the shelf for supporting a cylindrical rod for hanging clothes. The third bracket is adapted to be attached to the front edge of a first shelf for supporting the end of a second shelf which extends transversely of the first shelf. The fourth bracket is adapted to be screwed into the wall of a closet and connected to a first bracket for supporting the end of a shelf at any point along the length of the wall.

BRIEF DESCRIPTION OF THE DRAWINGS

The character of the invention, however, may be best understood by reference to one of its structural forms, as illustrated by the accompanying drawings, in which.

DETAILED DESCRIPTION OF THE INVENTION

Figure 1:
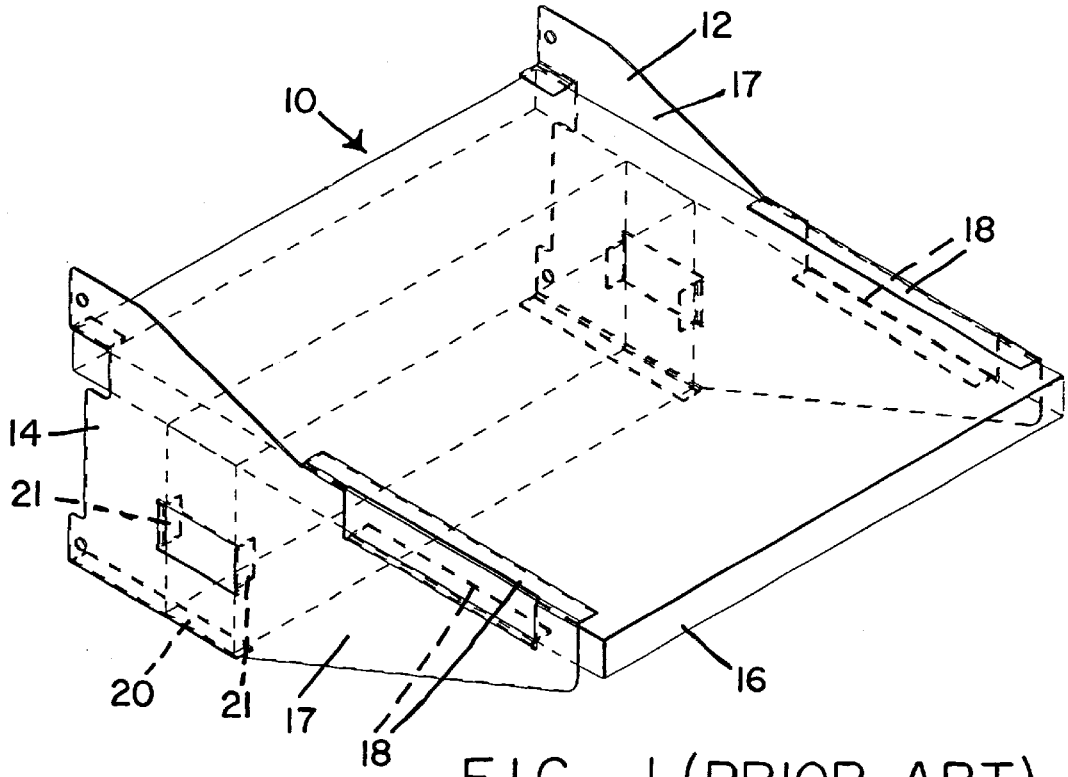
FIG. 1 (PRIOR ART)
FIG. 1 is an isometric view of a pair of right and left handed prior art shelf brackets shown support a shelf.

Referring first to FIG. 1, there is shown a prior art shelving installation, generally indicated by the reference numeral 10, such as that disclosed in my issued U.S. Pat. No. 4,951,908. Shelving installation 10 includes a left hand bracket 14 and a right hand bracket 12 for supporting a shelf 16. Each of the brackets 12 and 14 consists of a generally planar vertical plate 17 which has a pair of spaced inwardly facing horizontally extending shelf supporting flanges 18. Plate 17 also has a lower inwardly facing horizontal flange 20 for supporting a rectangular beam and a pair of spaced inwardly facing vertical flanges 21 for maintaining the rectangular beam in position on the flange 20. The brackets 12 and 14 are attached to opposite end walls of a closet so that the flanges 18 of one bracket face the flanges 18 of the opposite bracket. Each end of the shelf 16 is supported between a pair of flanges 18. The flanges 20 and 21 of each bracket support a rectangular beam such as a 2"×4" or 2"×3" beam.

Figure 2:
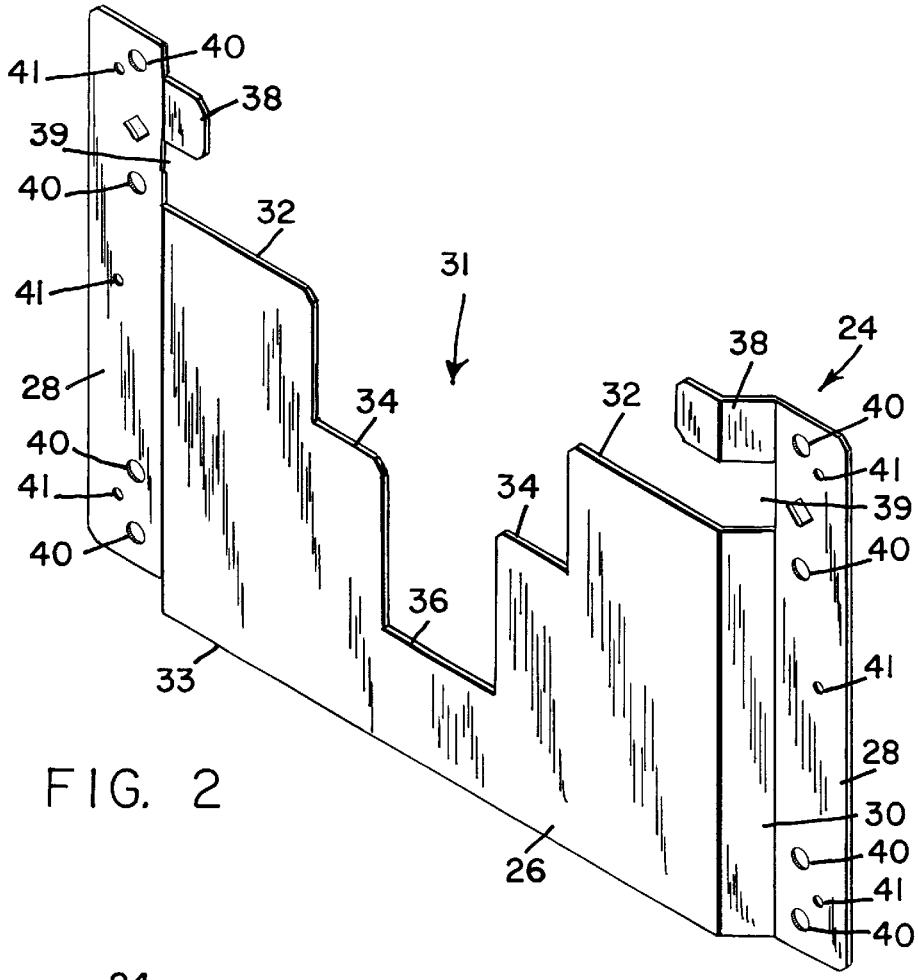
FIG. 2 is an isometric view of a first shelf bracket of the present invention and which is one of the bracket components of the present invention.
Figure 3:
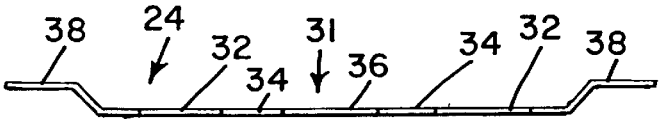
FIG. 3 is a top plan view of the first bracket.
Figure 4:
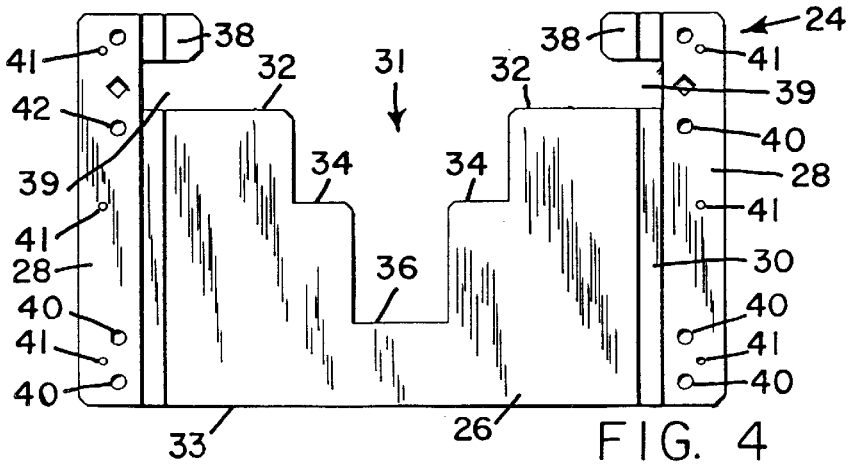
FIG. 4 is a front elevational view of the first bracket.

Referring to FIGS. 2–4, there is shown a first shelf bracket, generally indicated by the reference numeral 24, which forms a first component of applicants shelving system. Bracket 24 comprises a planar vertical main wall 26 and a pair of vertical end walls 28. Each end wall 28 is connected to the main wall 26 by an angled connecting wall 30 so that each end wall 28 is parallel to and spaced from the main wall 26. Each end wall 28 has a plurality of relatively large apertures 40 and a plurality of relatively small apertures 41. The main wall 26 has a bottom edge 33 and an upper edge surface 32. A T-shaped notch, generally indicated by the reference numeral 31, extends downwardly from the upper edge surface 32 centrally of the wall 26. The notch 31 has an intermediate upwardly facing edge surface 34 and a lower upwardly facing edge surface 36. An L-shaped retaining tab 38 is fixed to the upper end of each end wall 28 so that it is spaced from and is vertically aligned with the adjacent connecting wall 30 and the main wall 26. The space between the flange 38 and the top edge 32 of the main section 26 is indicated by the reference numeral 39.

Figure 19:
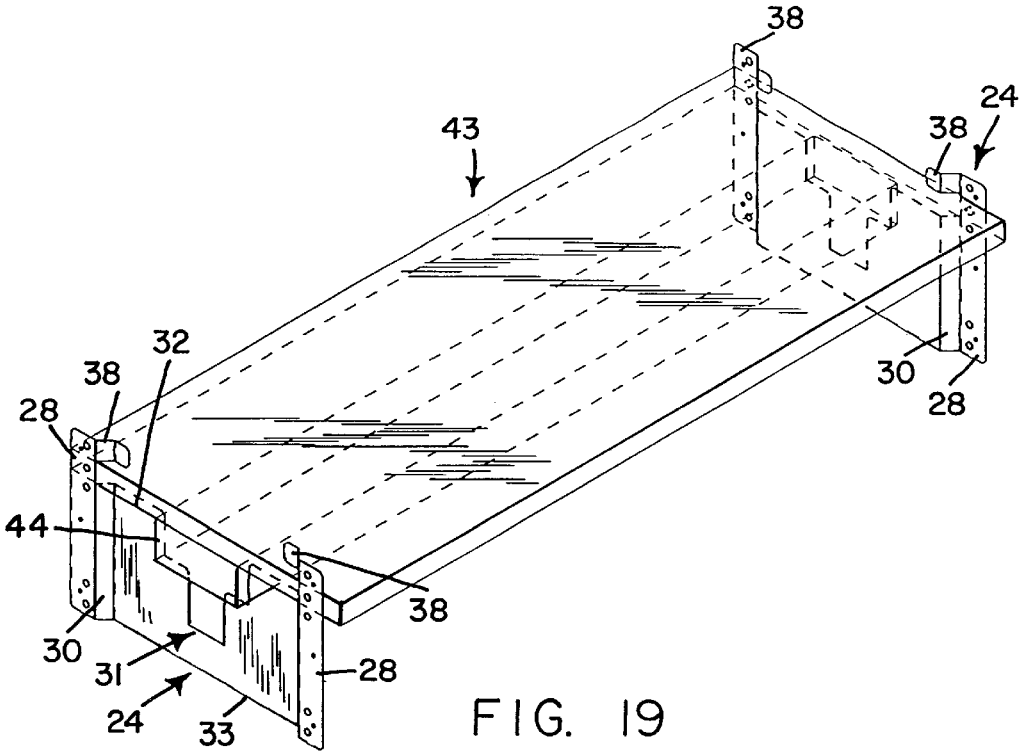
FIG. 19 is an isometric view showing a pair of first brackets being utilized for supporting a shelf and supporting beam.

Referring to FIG. 19, there is shown a shelf assembly, generally indicated by the reference numeral 43, which utilizes a pair of first shelf brackets 24 for supporting a shelf 42. The brackets 24 are mounted to opposite side walls of the closet by means of fasteners which are inserted through the apertures 40. Each end of the shelf 42 rests on the top surface 32 of a bracket 24 within the space 39 so that the retaining tabs 38 extend over the top surface of the shelf 42 to maintain the shelf in position on top of the upper edge surface 32. A solid rectangular beam 44 is located in the notches 31 of the brackets 24 and supported on the intermediate edge surfaces 34. The top of the beam 44 abuts the underside of the shelf 42 and provides rigidity to the shelf to prevent sagging of the shelf.

Figure 20:
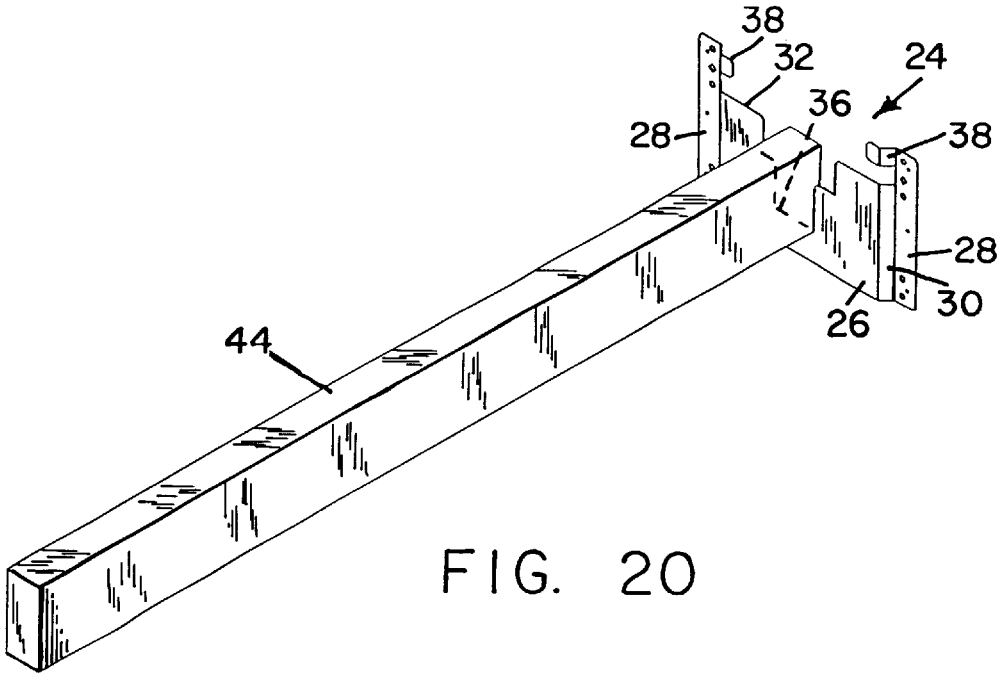
FIGS. 20 and 21 are isometric views showing a beam being supported in two different positions by the first bracket.
Figure 21:
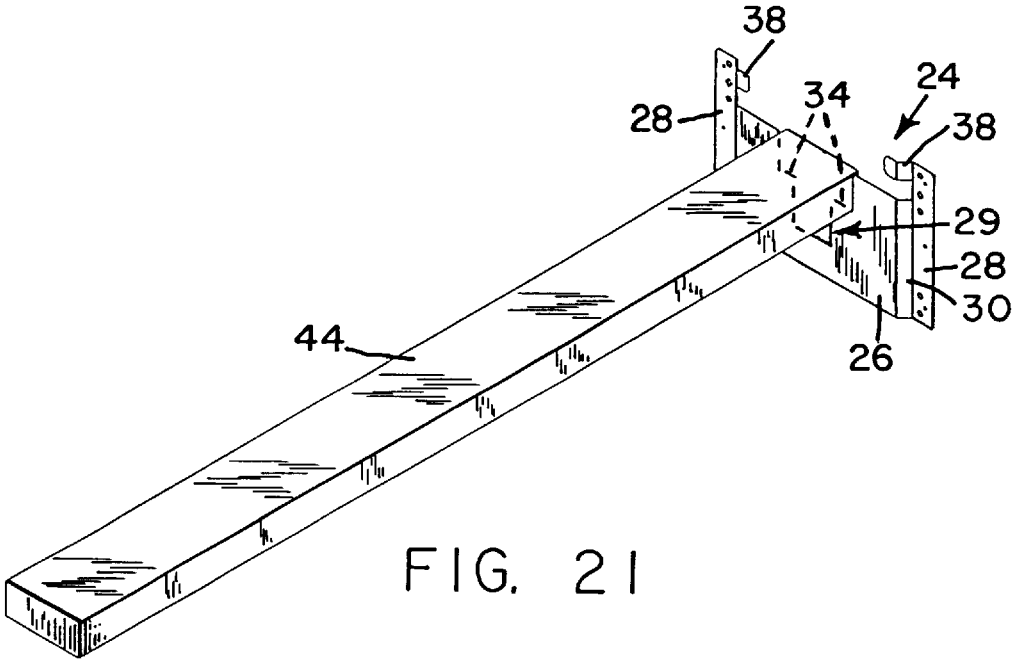
Figure 22:
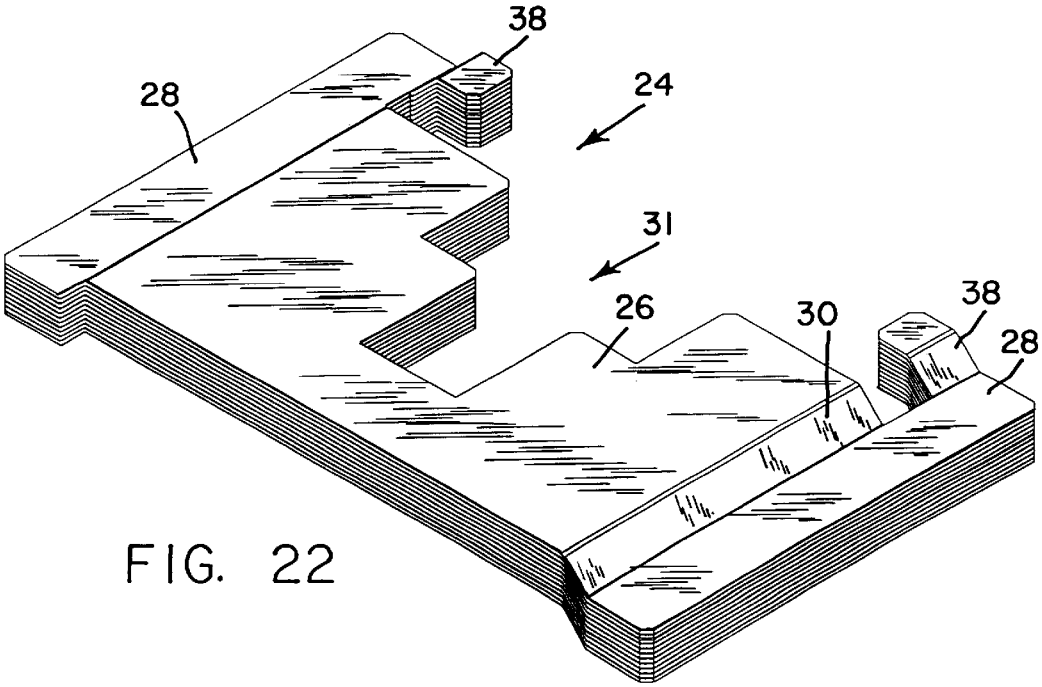
FIG. 22 is an isometric view of a plurality of first brackets illustrating how the first brackets can be arranged in a compact stack.

FIGS. 20 and 21 illustrate how the shelf bracket 24 is utilized for supporting the beam 44 in two different orientations. In FIG. 20, the beam 44 is shown oriented so that the wide side of the beam is vertical and the narrow side of the beam rests on the lower edge surface 36. In FIG. 21, beam 44 is oriented so that the wide sides of the beam are horizontal and the lower wide side rests on the intermediate edge surface 34. Bracket 24 provides the option of installing the support beam in two positions. One position offers maximum strength against deflection, as shown in FIG. 20. The second position, as shown in FIG. 21, provides a more compact profile for improved aesthetics and to increase the functional space between pantry and linen shelving.

Figure 5:
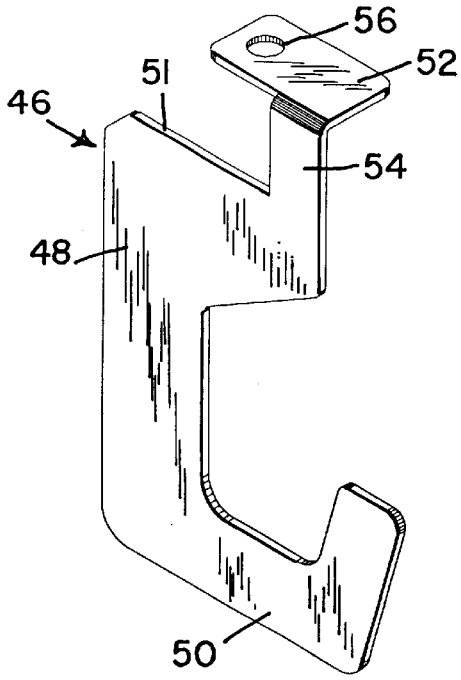
FIG. 5 is an isometric view of a hook shaped bracket which is a second bracket component system of the present invention.
Figure 6:
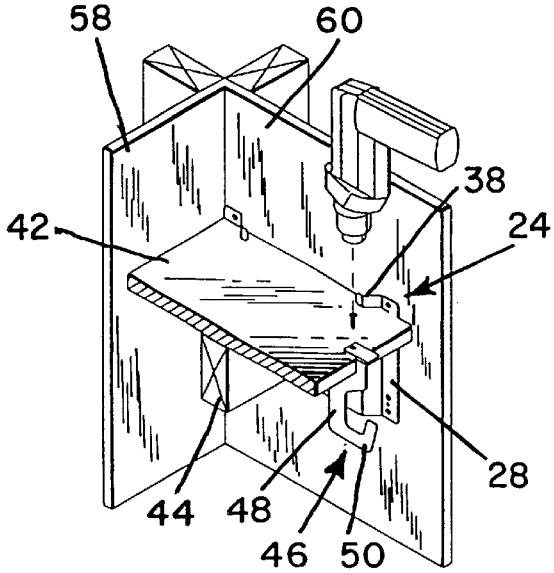
FIG 6 is an isometric view of a shelving installation utilizing the first and second brackets of the present invention.
Figure 7:
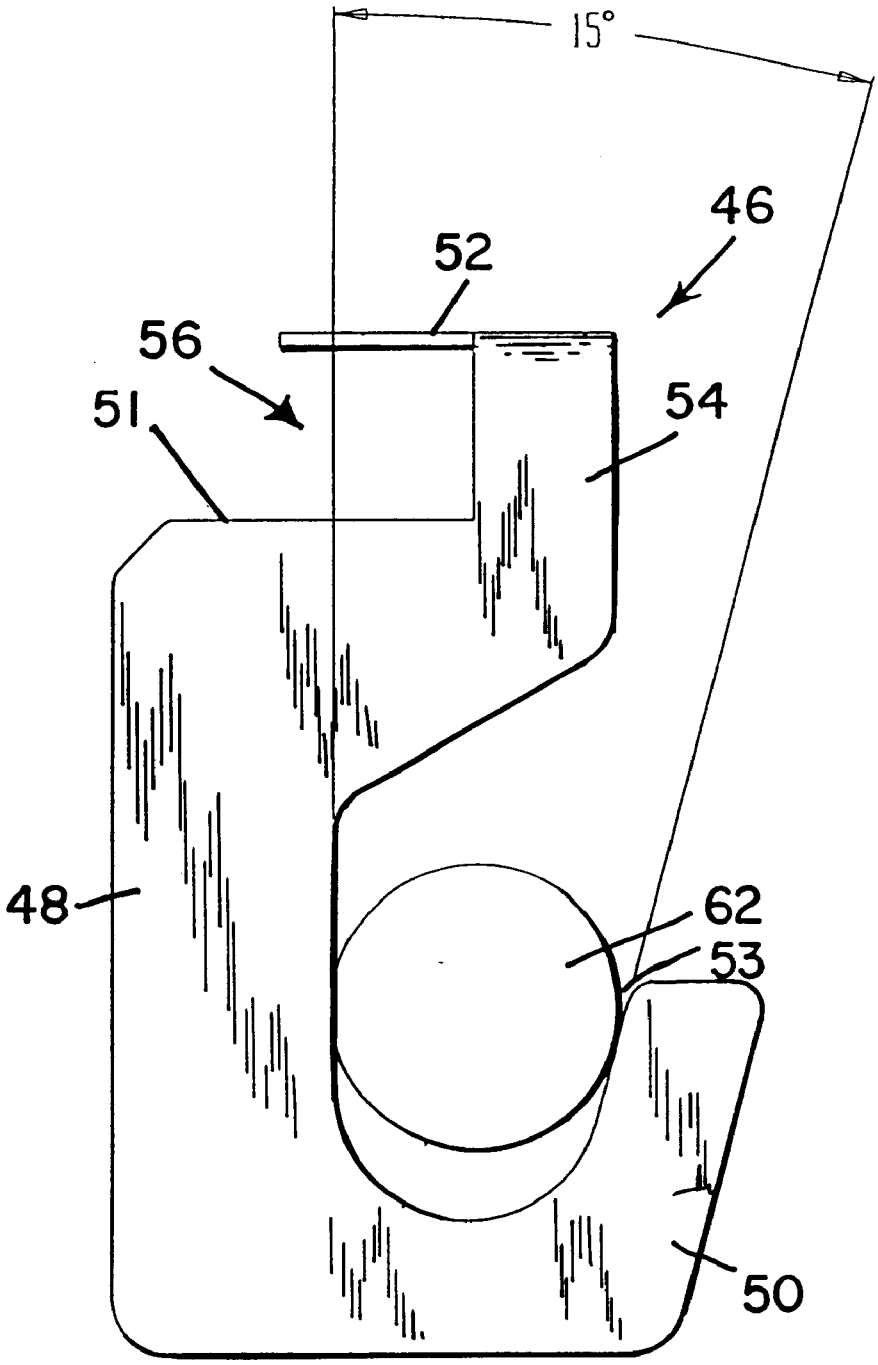
FIG. 7 is a side elevational view of the second bracket on an enlarged scale.

Referring to FIGS. 5–7, a second shelf bracket component of the present invention is generally indicated by the reference numeral 46. Bracket 46 comprises a flat vertical plate 48 which has an upper edge surface 51. The lower end of plate 48 has hook shaped portion 50 which has an upwardly facing opening 53. A vertical flange 54 extends upwardly from the plate 48. A horizontal flange 52 is fixed to the upper end of the vertical flange 54. The horizontal flange 52 is spaced from and vertically aligned with the upper edge surface 51 and contains an aperture 56. The hook-shaped lower portion 50 is utilized to support a cylindrical wooden rod or beam 62, as shown in FIG. 7.

Referring specifically to FIG. 6, there is illustrated a shelving installation which utilizes brackets 24 and 46. The right rear comer of the closet, as illustrated in FIG. 6, consists of a back wall 58 and a right side wall 60. A first shelf bracket 24 is screwed to the side wall 60 for supporting one end of each of the shelf 42 and the beam 44. A second shelf bracket 46 is applied to the shelf 42 so that the upper edge surface 51 abuts the bottom surface of the shelf and the flange 52 abuts the top surface of the shelf. The shelf bracket 46 is fixed to the shelf 42 by inserting a screw through the aperture 56 into the shelf. This enables the bracket 46 to support one end of the cylindrical beam 62. Several brackets 46 can be installed along the shelf edge at approximately 20 inch to 36 inch intervals for the entire length of the shelf. The hook 50 has a tapered section that is sized to accept a standard wood rod of 1¼ inch and 1⁵⁄₁₆ inch diameter. The tapered section secures the wood rod in position and prevents movement of the rod 62 in a horizontal direction by the wedging action of the taper. The tapered section of the hook 50 is defined by the inclusive angle shown in FIG. 7.

Figure 8:
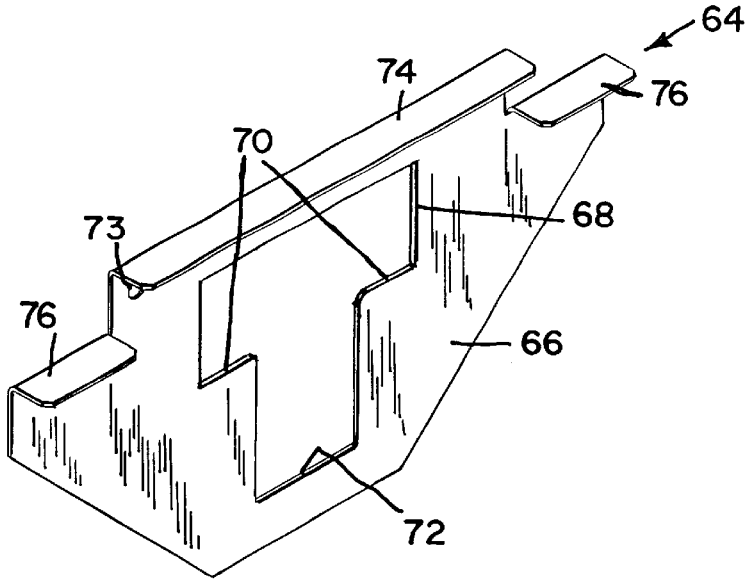
FIG. 8 is an isometric view of a third bracket component of the present invention.
Figure 9:
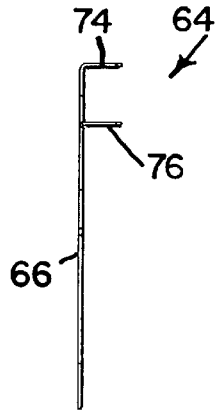
FIG. 9 is a side elevational view of the third bracket.
Figure 10:
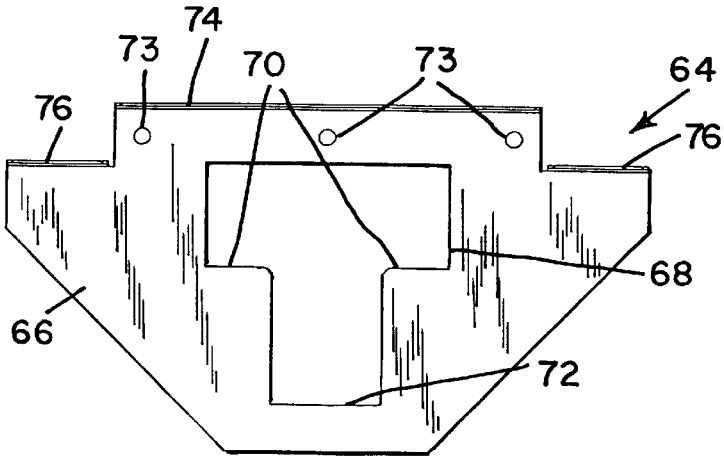
FIG. 10 is a front elevational view of the third bracket.

Referring to FIGS. 8–10, a third shelf bracket component of the present invention is generally indicated by the reference numeral 64 and comprises a main vertical wall 66 having a T-shaped aperture 68. The aperture 68 has an intermediate upwardly facing edge surface 70 and a lower upwardly facing edge surface 72. A central flange 74 is located at the top edge of the wall 66. A pair of horizontal end flanges 76 are located at opposite ends of the plate 66 outside of and below the central flange 74. A plurality of apertures 73 are located in the plate 66 just below the central flange 74.

Figure 11:
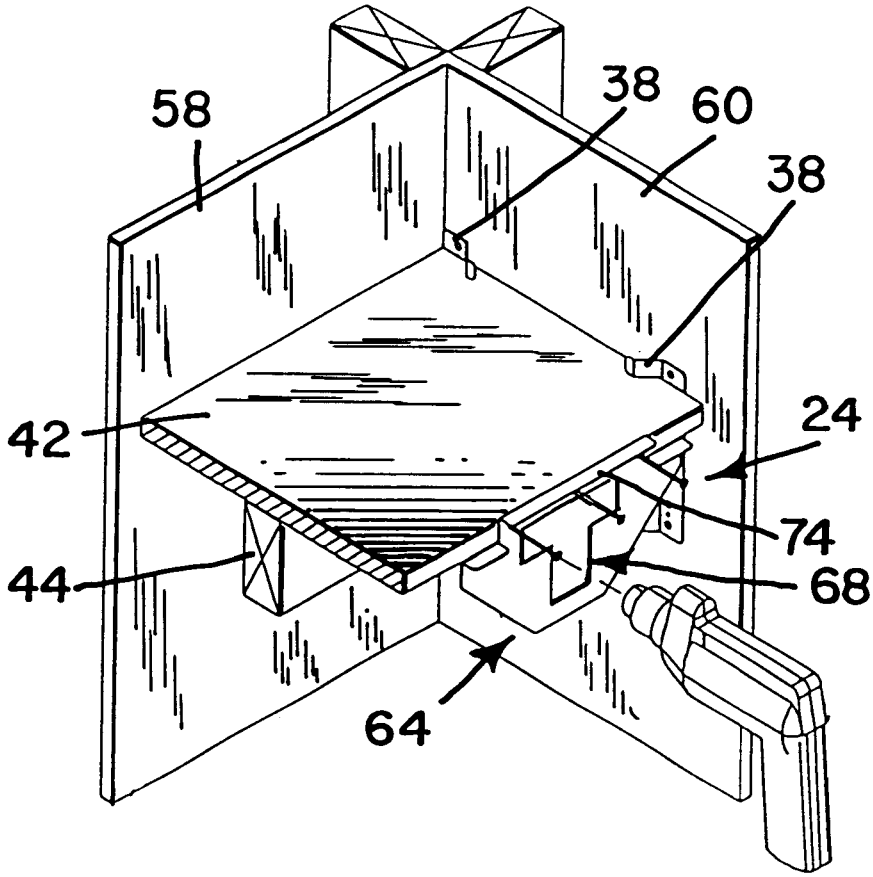
FIGS. 11–13 are isometric views of a shelving installation utilizing the first and third brackets.
Figure 12:
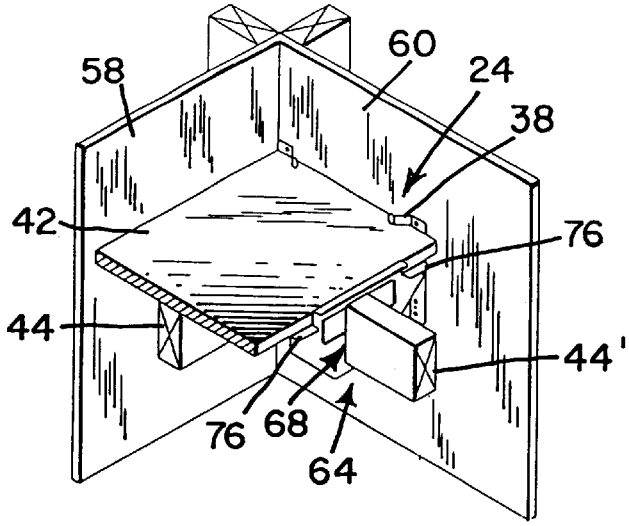
Figure 13:
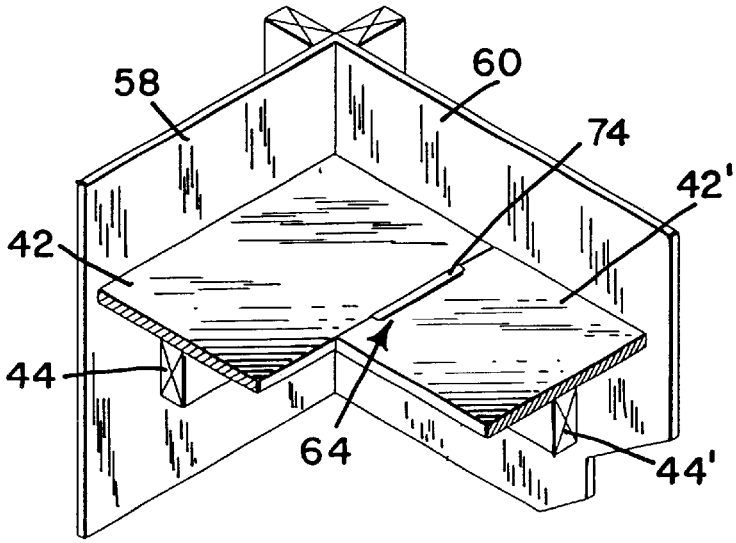

FIG. 11 illustrates a shelving installation which utilizes a first shelf bracket 24 and a third shelf bracket 64. Each end of the shelf 42 is supported by a first shelf bracket 24, one of which is shown in FIG. 11. The bracket 24 is attached to the right side wall 60 by screws. The shelf 42 is supported along the length by beam 44. The shelf bracket 64 is screwed to the front edge of the shelf 42 by inserting the screws through the apertures 73 into the front edge of the shelf so that the bottom surface of the flange 74 lies in the same plane as the top surface of the shelf 42 and the top surface of the flange 76 lies in the same plane as the bottom surface of the shelf 42. A beam 44' is inserted into the aperture 68, as shown in FIG. 12. One end of a shelf 42' is inserted between the central flange 74 and the two end flanges 76 and on top of the beam 44', as shown in FIG. 13. Shelf 42' extends from the third bracket 64 to the front of the closet. Bracket 44 provides a means of supporting continuous shelving from the comer of two intersecting walls such as a back wall and a side wall. The shelves are in the same plane and extend as a continuous shelf around the rear corner of the closet.

Figure 14:
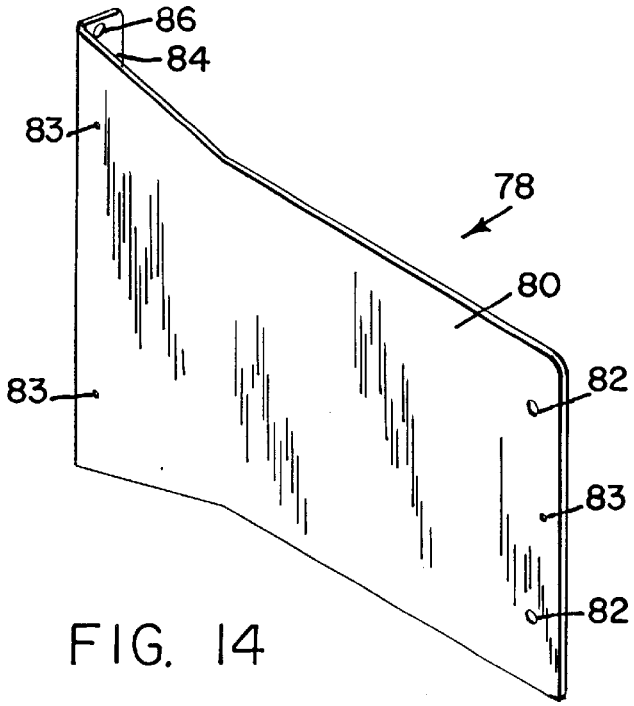
FIG. 14 is an isometric view of a fourth bracket component of the present invention.
Figure 15:
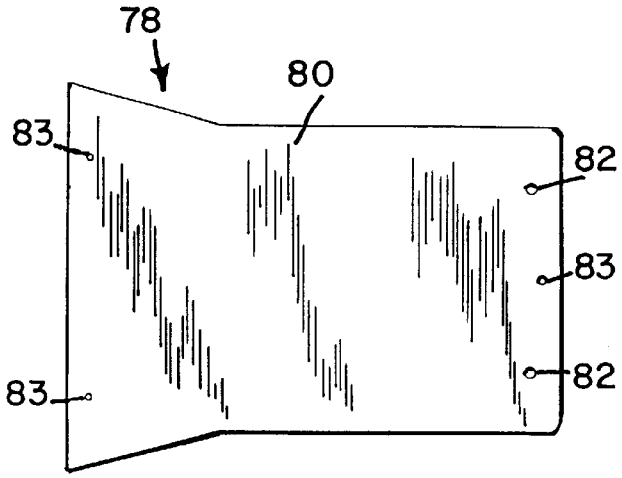
FIG. 15 is a front elevational view of the fourth bracket.
Figure 16:
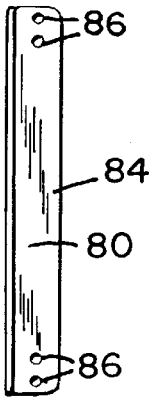
FIG. 16 is a right hand end view of the fourth bracket.

Referring to FIGS. 14–16, a fourth shelf bracket component of the present invention is generally indicated by the reference numeral 78, and comprises a vertical main wall 80. Wall 80 contains a plurality of relatively large diameter holes 82 and a plurality of relatively small diameter holes 83. One end of the wall 80 has a vertical flange 84 which extends laterally from the vertical plane of the wall 80 and contains a plurality of apertures 86.

The fourth shelf bracket 78 is adapted to be combined with the first shelf bracket 24 for providing additional support at any point between the end walls of the closet.

Figure 17:
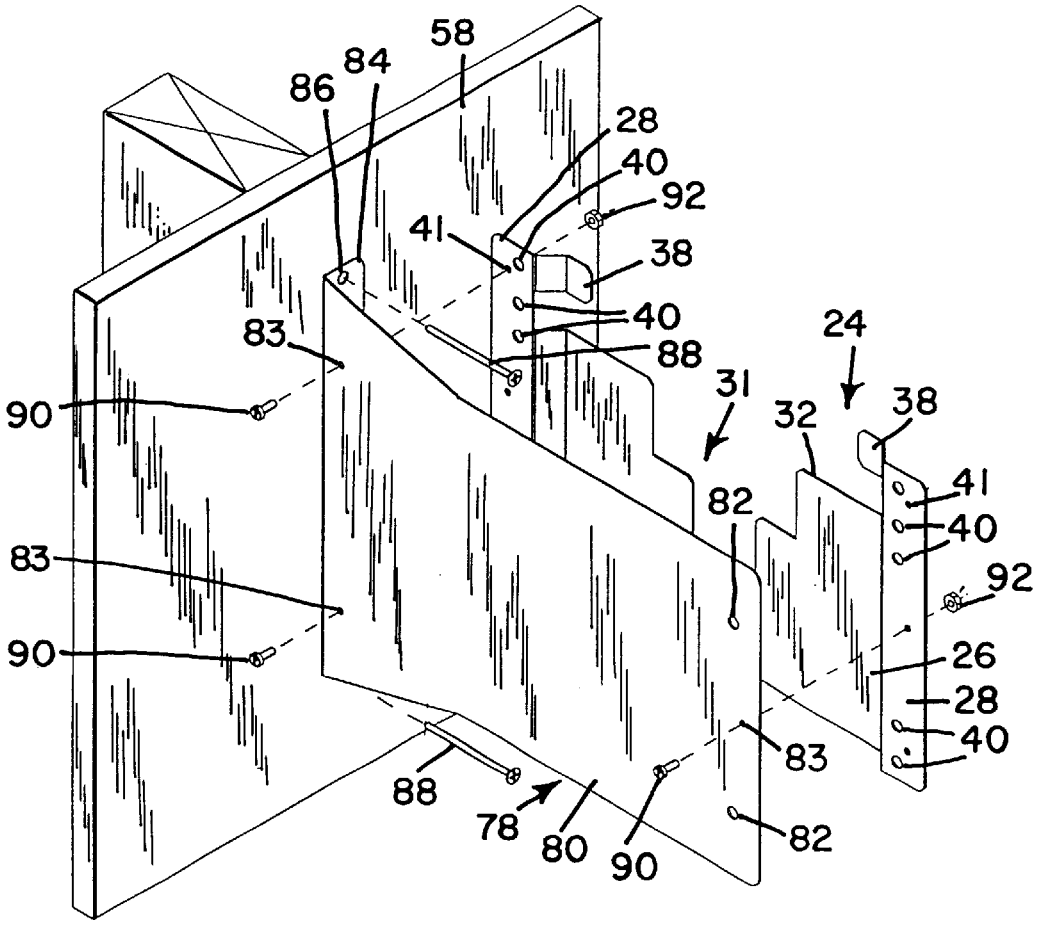
FIGS. 17 and 18 are isometric views of a shelving installation utilizing the first and fourth brackets.
Figure 18:
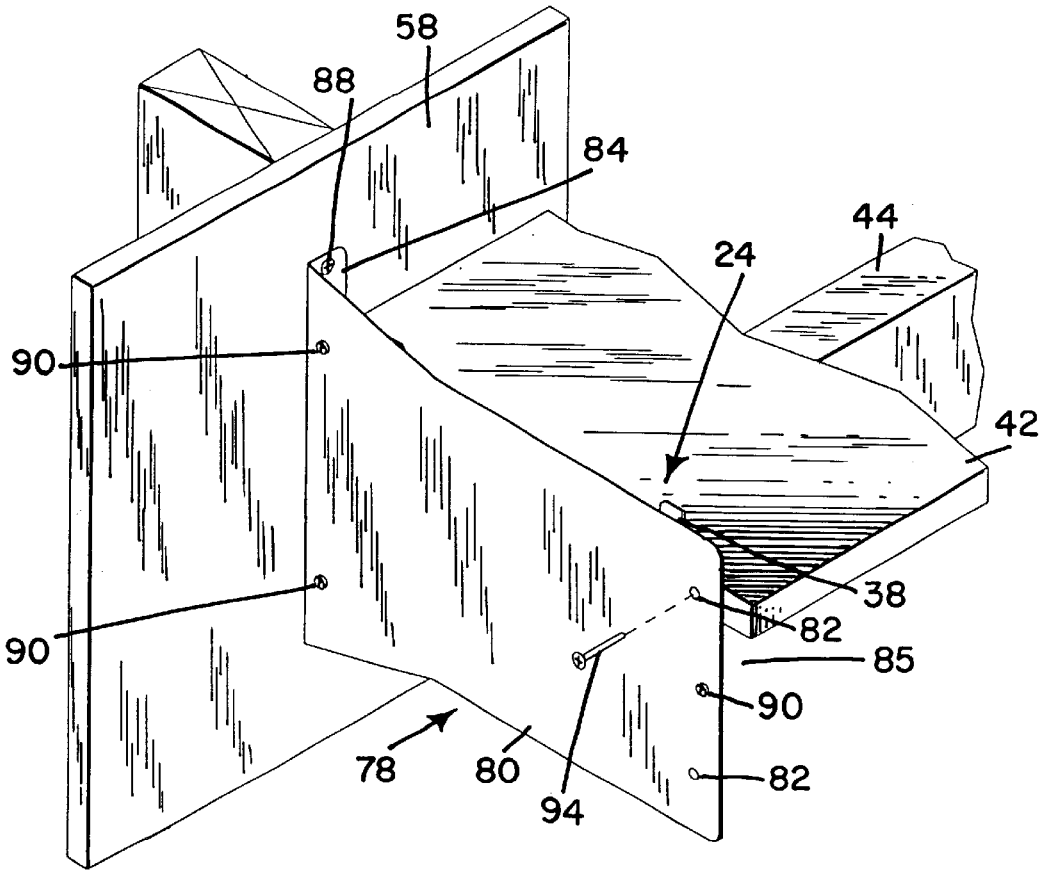

As shown in FIG. 17, a fourth bracket 78 is applied to the back wall 58 of the closet, preferably where an interior wall stud is located. Screws 88 are inserted through the apertures 86 into the back wall 58. A first shelf bracket 24 is applied to the fourth shelf bracket 78 by aligning the apertures 83 and bracket 78 to the appropriate apertures 41 in bracket 24 and securing the bracket 24 to the bracket 78 by means of bolts 90 and nuts 92, as shown in FIG. 18. The inner end of the shelf 42 is supported on the top edge surface 32 of the bracket 24 and the bracket 78 is secured to the shelf 42 by inserting screws 94 through the apertures 82 and screwing the screw 94 into the edge of the shelf 42. A shown in FIG. 18, the combined first and second shelf brackets 24 and 78, respectively, form a mid wall shelf bracket subcombination, generally indicated by the reference numeral 85. This subcombination is used in instances where it is not desired to extend shelving for the entire length of the closet, as shown, for example, in FIG. 23.

Figure 23:
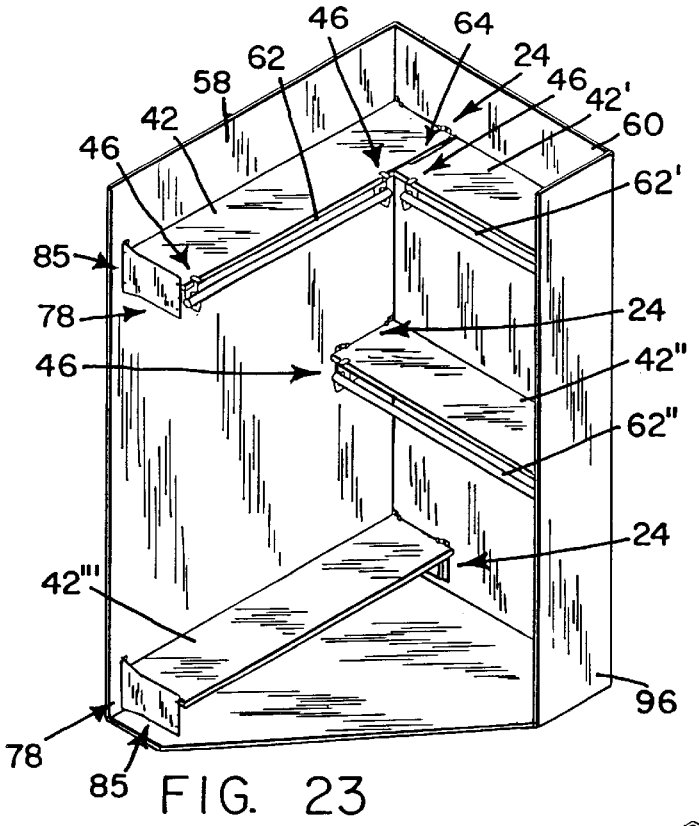
FIG. 23 is an isometric view of a shelving installation utilizing all four brackets of the present invention.

The shelving installation, as illustrated in FIG. 23, utilizes all of the brackets 24, 46, 64, and 80. A first shelf bracket 24 is fastened to the right side wall 60 at the back right corner of the closet and a combination shelf bracket 85 of a first shelf bracket 24 and a third shelf bracket 78 is fastened to the back wall 58. A pair of second shelf brackets 46 are attached to the front edge of the shelf 42 for supporting a cylindrical rod 62. A second shelf bracket 46 is attached to the shelf 42 near the right side wall 60 of the closet and a bracket 24 which cannot been seen in FIG. 23 is attached to the front wall 96 of the closet for supporting shelf 42'. A pair of second shelf brackets 46 are attached to the shelf 42' for supporting a second cylindrical rod or beam 62'.

As also illustrated in FIG. 23, a third shelf 42" is supported at an intermediate height by a pair of first shelf brackets 24 fastened to the bracket wall 58 and the front wall 96. A pair of second shelf brackets 46 are attached to the shelf 42" for supporting a third cylindrical rod or beam 62". A third shelf 42"' is supported at a lower position by a first shelf bracket 24 fixed to the right side wall 60 and a combination shelf bracket 85 which is attached to the rear wall 58 of the closet.

Figure 24:
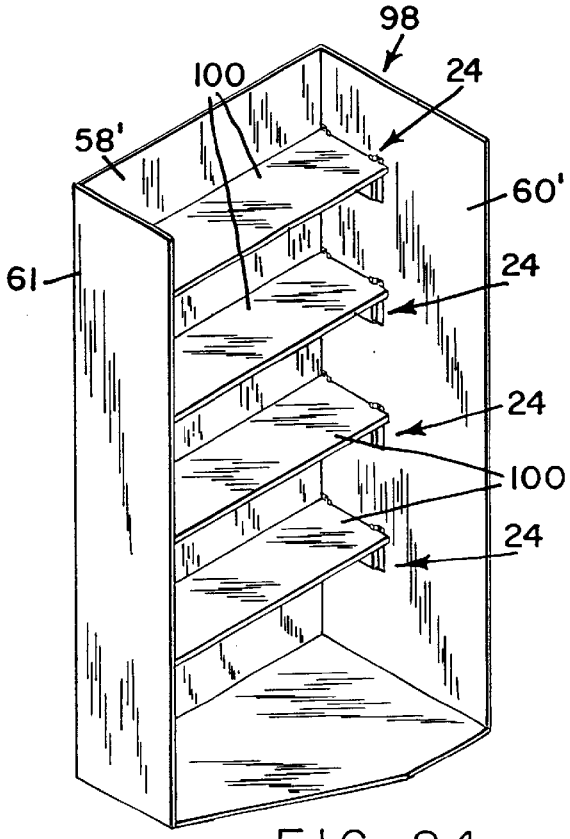
FIG. 24 is an isometric view of a shelving installation utilizing a plurality of first brackets.

FIG. 24 illustrates shelving for a relative small linen pantry closet, generally indicated by the reference numeral 98. Closet 98 has a rear wall 58', a right side wall 60', and a left side wall 61. The bracket 24 is attached to each of the side walls 60' and 61 at different heights, as shown in FIG. 24, for supporting a plurality of shelves 100.

What is claimed is:

1. A bracket apparatus for supporting a shelf in a closet having a back wall and at least one side wall, said bracket apparatus comprising:

(a) a first bracket comprising:

(1) a vertical end wall for extending parallel with said back wall and for connecting said first bracket to said back wall; and (2) a vertical primary wall extending transversely from said end wall for extending transversely of said back wall; and (b) a second bracket comprising:

(1) a planar vertical main wall having a horizontal upper edge surface for supporting one end of a shelf, said main wall having a first end and a second end;

(2) a first vertical end wall connected to the first end of said main wall; and (3) a second vertical end wall connected to the second end of said main wall, beam each of said first and second end walls located in a vertical plane which is spaced from the plane of said main wall for enabling said first and second vertical end walls to be connected to the primary wall of said first bracket so that said horizontal upper edge surface is spaced from said primary wall.

2. The bracket apparatus as recited in claim 1, wherein each of said first and second vertical end walls has a retaining tab that is vertically aligned with said horizontal upper edge surface and spaced above said horizontal upper edge surface for enabling said shelf to be positioned between said tab and said horizontal upper edge surface.

3. The bracket apparatus as recited in claim 1, wherein said horizontal upper edge surface has a vertical upper notch for receiving a beam, said upper notch comprising an upper opening, a pair of opposed and spaced vertical side edge surfaces and a horizontal intermediate edge surface for supporting said beam.

4. The bracket apparatus as recited in claim 3, wherein said intermediate edge surface has a lower notch comprising an intermediate opening which is narrower than said beam, a pair of opposed and spaced vertical side edge surfaces, and a horizontal lower edge surface for supporting a supporting beam which is narrower than said intermediate opening.

5. A shelving structure for supporting clothing in a closet having a back wall, a first side wall and an opposite second side wall, said shelving structure comprising:

(a) a first bracket comprising:

(1) a planar vertical main wall having a horizontal upper edge surface, said main wall having a first end and a second end;

(2) a first vertical end wall connected to the first end of said main wall; and (3) a second vertical end wall connected to the second end of said main wall, each of said first and second end walls located in a vertical plane which is spaced from the plane of said main wall for enabling said first and second walls to be connected to the first side wall of said closet so that said horizontal upper edge surface is spaced from said first side wall;

(b) a horizontal shelf having a first end, a second end and a front edge, said first end being supported on said upper edge surface;

(c) a second bracket having an upper end connected to the front edge of said shelf adjacent said first bracket and a lower end which has an upwardly facing hook for supporting one end of clothes hanger support rod;

(d) a third bracket which is identical to said first bracket for being connected to the second side wall of said closet for supporting the second end of said shelf; and (e) a fourth bracket which is identical to said second bracket connected to the front edge of said shelf adjacent said third bracket for supporting the opposite end of said clothes hanger support rod.

6. A shelving structure as recited in claim 5, wherein each of the first and second end walls of each of said first and third brackets has a retaining tab that is vertically aligned with the corresponding horizontal upper edge surface and spaced above said corresponding horizontal upper edge surface for enabling said shelf to be positioned between said tab and said corresponding horizontal upper edge surface.

7. A shelving structure for supporting clothing in a closet having a back wall, a first side wall and an opposite second side wall, said shelving structure comprising:

(a) a first bracket comprising:

(1) a planar vertical main wall having a horizontal upper edge surface, said main wall having a first end and a second end;

(2) a first vertical end wall connected to the first end of said main wall; and (3) a second vertical end wall connected to the second end of said main wall, each of said first and second end walls being located in a vertical plane which is spaced from the plane of said main wall for enabling said first and second walls to be connected to the first side wall of said closet so that said horizontal upper edge surface is spaced from said first side wall;

(b) a horizontal first shelf having a first end supported on said upper edge surface, a second end, an upper surface and a front edge,;

(c) first support means for supporting the second end of said first shelf for enabling said first shelf to extend along the back wall of said closet;

(d) a second bracket comprising:

(1) a main vertical wall connected to the front edge of said first shelf;

(2) a horizontal upper flange located immediately above the upper surface of said first shelf; and (3) a horizontal lower flange immediately below the lower surface of said first shelf;

(e) a horizontal second shelf having a first end, and a second end, the first end of said second shelf being supported on said lower flange and below said upper flange so that said second shelf is in the same horizontal plane as said first shelf; and (f) second support means for supporting the second end of said second shelf for enabling said second shelf to extend along the first side wall of said closet.

8. The shelving structure as recited in claim 7, wherein each of said first and second walls has a retaining tab that extends above the upper surface of said first shelf.

9. The shelving structure as recited in claim 7, wherein the horizontal upper edge surface of said first bracket has a vertical upper notch for receiving a supporting beam, said upper notch comprising an upper opening, a pair of opposed and spaced vertical side edge surfaces and a horizontal intermediate edge surface for supporting said beam.

10. The shelving structure as recited in claim 7, wherein said main vertical wall of said second bracket has a relatively large aperture for receiving a supporting beam, said aperture having a pair of opposed and spaced vertical edge surfaces and a horizontal intermediate edge surface for supporting said beam.

11. The shelving structure as recited in claim 10, wherein said aperture is T shaped and comprises an opening in said horizontal intermediate edge surface, a horizontal lower edge surface spaced from and below said intermediate edge surface and a pair of spaced vertical edge surfaces extending from said intermediate edge surface to said lower edge surface.

12. A shelf bracket comprising:

(a) a planar vertical main wall having a horizontal upper edge surface for supporting one end of a shelf, said main wall having a first end and a second end, said horizontal upper edge surface having a vertical upper notch for receiving a beam, said upper notch comprising an upper opening, a pair of opposed and spaced vertical side edge surfaces and a horizontal intermediate edge surface for supporting said beam, said intermediate edge surface having a lower notch comprising an intermediate opening at said horizontal intermediate edge surface which is narrower than said beam, a pair of opposed and spaced vertical side edge surfaces, and a horizontal lower edge surface for supporting a beam which is narrower than said intermediate opening;

(b) a first vertical end wall connected to the first end of said main wall; and (c) a second vertical end wall connected to the second end of said main wall, each of said first and second end walls located in a vertical plane which is spaced from the plane of said main wall for enabling said first and second walls to be connected to a side wall of a closet so that said horizontal upper edge surface is spaced from said side wall.

13. A shelf bracket comprising:

(a) a main vertical wall having a relatively large T shaped aperture for receiving a supporting beam, said aperture having a pair of opposed and spaced vertical edge surfaces and a horizontal intermediate edge surface for supporting said beam, said T shaped aperture comprising an opening in said horizontal intermediate edge surface, a horizontal lower edge surface spaced from and below said intermediate edge surface and a pair of spaced vertical edge surfaces extending from said intermediate edge surface to said lower edge surface;

(b) a horizontal upper flange above said aperture; and (c) a horizontal lower flange spaced from and below said upper flange, said lower flange being spaced from and above said intermediate edge surface for supporting a shelf.

14. A shelf bracket comprising:

(a) a vertical wall having a horizontal upper supporting surface and a T shaped opening having an upper portion and a lower portion below said upper supporting surface, said upper portion having a pair of spaced and opposed vertical side edge surfaces, a horizontal intermediate supporting surface spaced from and below said upper supporting surface, said lower portion having a horizontal lower supporting surface spaced from and below said horizontal intermediate supporting surface and a pair of spaced vertical edge surfaces extending from said horizontal intermediate supporting surface to said lower supporting surface; and (b) a horizontal retaining tab spaced from and above said upper supporting surface.

15. A shelving structure for supporting clothing in a closet having a back wall, a first side wall and an opposite second side wall, said shelving structure comprising:

(a) a first bracket comprising:

(1) a planar vertical main wall having a horizontal upper edge surface, said main wall having a first end and a second end, said horizontal upper edge surface having a vertical upper notch for receiving one end of a beam, said upper notch comprising an upper opening, a pair of opposed and spaced vertical side edge surfaces and a horizontal intermediate edge surface for supporting said one end of said beam;

(2) a first vertical end wall connected to the first end of said main wall; and (3) a second vertical end wall connected to the second end of said main wall, each of said first and second end walls located in a vertical plane which is spaced from the plane of said main wall for enabling said first and second walls to be connected to the first side wall of said closet so that said horizontal upper edge surface is spaced from said first side wall;

(b) a horizontal shelf having a first end, a second end and a front edge, said first end being supported on said upper edge surface;

(c) a second bracket having an upper end connected to the front edge of said shelf adjacent said first bracket and a lower end which has an upwardly facing hook for supporting one end of a clothes hanger support rod;

(d) a third bracket which is identical to said first bracket for being connected to the second side wall of said closet for supporting the second end of said shelf and the opposite end of said beam; and (e) a fourth bracket which is identical to said second bracket connected to the front edge of said shelf adjacent said third bracket for supporting the opposite end of said clothes hanger support rod.

16. A shelf bracket as recited in claim 15, wherein said intermediate edge surface has a lower notch comprising an intermediate opening which is narrower than said beam, a pair of opposed and spaced vertical side edge surfaces, and a horizontal lower edge surface for supporting a supporting beam which is narrower than said intermediate opening.

* * * * *